United States Patent [19]

Kim

[11] Patent Number: 4,577,778

[45] Date of Patent: Mar. 25, 1986

[54] REFUSE RECEPTACLE

[75] Inventor: Myong H. Kim, Seoul, Rep. of Korea

[73] Assignee: Woo Kyong Industrial Co., Ltd., Seoul, Rep. of Korea

[21] Appl. No.: 730,057

[22] Filed: May 3, 1985

[30] Foreign Application Priority Data

Dec. 31, 1984 [KR] Rep. of Korea ..... 14575/84

[51] Int. Cl.[4] ..... B65D 67/04

[52] U.S. Cl. ..... 220/404; 220/1 T; 220/407; 206/303

[58] Field of Search ..... 220/1 T, 404, 407; 53/390; 206/303

[56] References Cited

U.S. PATENT DOCUMENTS

| | | | |
|---|---|---|---|
| 3,392,825 | 7/1968 | Gale et al. | 220/407 X |
| 3,536,192 | 10/1970 | Couper | 206/303 |
| 3,800,503 | 4/1974 | Maki | 220/407 X |
| 3,872,906 | 3/1975 | Bolanz | 53/390 X |
| 3,893,615 | 7/1975 | Johnson | 220/1 T X |
| 3,974,912 | 8/1976 | Buisson | 206/303 |
| 4,212,407 | 7/1980 | Lydon | 220/1 T X |

*Primary Examiner*—Steven M. Pollard

*Attorney, Agent, or Firm*—Watson, Cole, Grindle & Waston

[57] ABSTRACT

A refuse receptacle having a refuse collecting bag mounted therein comprising a continuous elongated vinyl sleeve folded several times on itself in fanfold manner to an appropriate length outwardly and inwardly by turns starting from one end thereof. The other end of the folded vinyl sleeve is tied and pulled downwardly for receiving refuse directly.

5 Claims, 2 Drawing Figures

REFUSE RECEPTACLE

BACKGROUND OF THE INVENTION

This invention relates generally to a refuse receptacle, and more particularly to a refuse receptacle provided with a refuse collecting bag.

U.S. Pat. Nos. 4,319,694 and 4,364,490 each disclose a refuse receptacle having refuse collecting bags which are detachably connected with each other and mounted within the receptacle so that each of the connected bags can be pulled sequentially upwardly and the upper end of the upwardly pulled bag can be opened for receiving refuse.

The drawbacks of the refuse receptacles according to these patents are that refuse collecting bags prepared so as to each have a predetermined length must be detachably interconnected to form a suitable number of bags, each of the refuse collecting bags connected together must in use be pulled upwardly through the receptacle and opened at the upper end thereof, and the bag filled with refuse must be removed upwardly from the upper end of the refuse receptacle.

SUMMARY OF THE INVENTION

It is therefore an object of the present invention to provide a refuse receptacle wherein a continuous and elongated vinyl sleeve may be used as a refuse collecting bag.

Another object of the present invention is to provide a refuse receptacle which avoids the need, in use, to pull out each refuse collecting bag upwardly within the receptacle and to open the upper end of the bag.

A further object of the present invention is to provide a refuse receptacle wherein the bag filled with refuse may be removed out downwardly through the lower part of the receptacle.

According to the present invention, there is provided a refuse receptacle comprising an outer enclosure and a refuse collecting bag mounted therein, the outer enclosure having a refuse inlet opening the front upper portion thereof and an opening for taking out the refuse filled bag, and the refuse collecting bag comprising a continuous, elongated vinyl sleeve folded several times on itself in fanfold manner to an appropriate length outwardly and inwardly by turns starting from one end thereof, the folded sleeve being mounted on the inside of the upper portion of the outer enclosure, and the other end of the folded vinyl sleeve being tied and pulled downwardly for receiving refuse directly within the enclosure.

According to one aspect of the present invention, the folded vinyl sleeve is mounted on the outer peripheral surface of a tubular holder having substantially the same length and outer diameter as the folded length and inner diameter of the sleeve, one end of the folded sleeve being pulled downwardly through the tubular holder, and the holder having the folded sleeve mounted thereon being mounted on the inside of the upper portion of the outer enclosure.

Outwardly facing flanges are provided on the lower end of the tubular holder and/or the inside of the upper portion of the enclosure has a pair of fixed elongated support members for supporting the holder in face-to-face relationship.

Other objects, advantages and novel features of the invention will become more apparent from the following detailed description of the invention when taken in conjunction with the accompanying drawings.

DETAILED DESCRIPTION OF THE INVENTION

A manner of carrying out the present invention is set forth with reference to the drawings.

Figure 1:
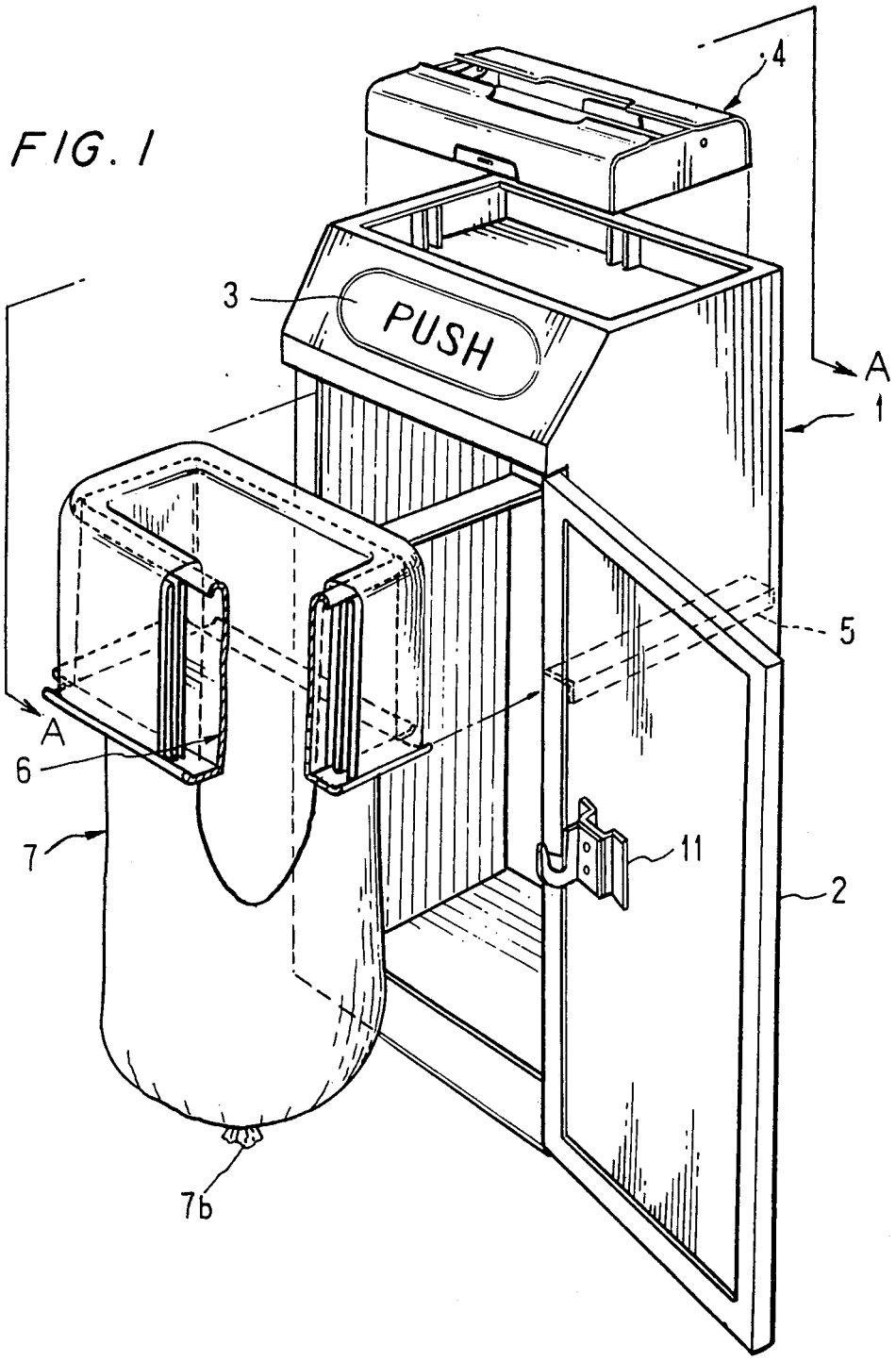
FIG. 1 is a perspective view of a refuse receptacle embodying the present invention, the tubular holder supporting the folded sleeve being shown disassembled with the outer enclosure.

FIG. 1 discloses the structure of a refuse receptacle according to the present invention, the receptacle comprising an outer enclosure 1 in the form of a rectangular box having a front side arranged to be opened and closed by a door 2 to permit downward removal of a refuse filled bag.

Figure 2:
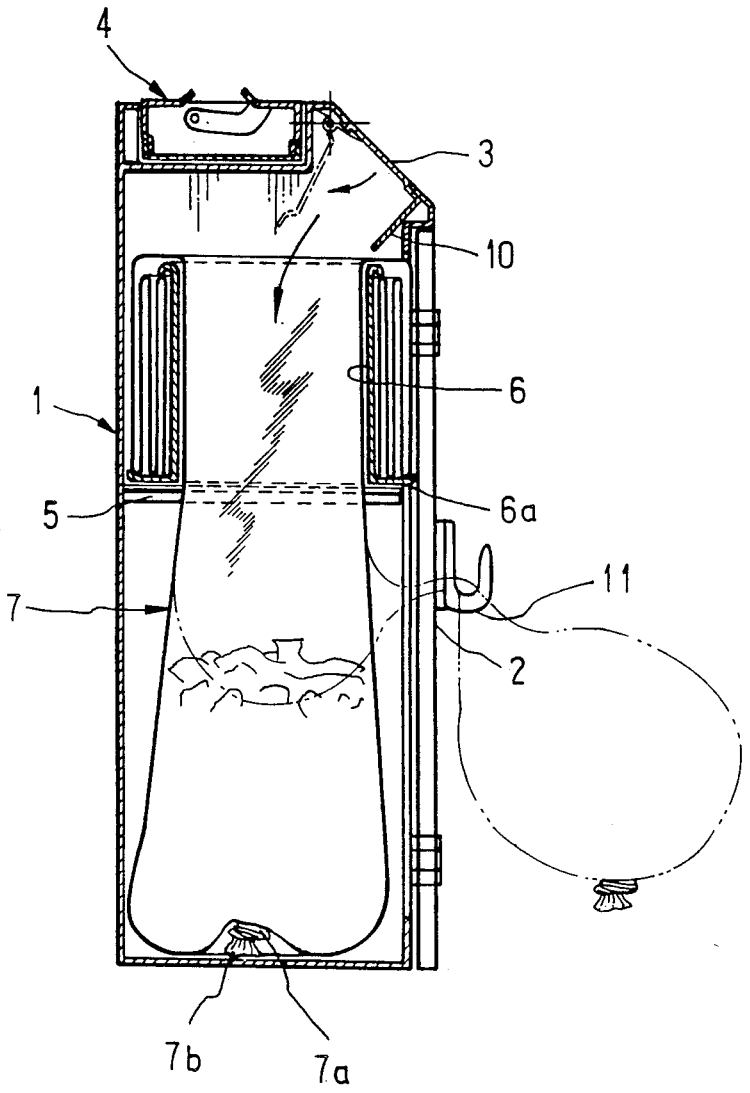
FIG. 2 is a cross-sectional view taken substantially along the line A—A of FIG. 1, the tubular holder supporting the folded sleeve being mounted within the outer enclosure.

The upper part of the front side of enclosure 1 is rearwardly inclined and has a refuse inlet opening closed by a spring biased door 3. And, the upper end portion of enclosure 1 is adapted for mounting an ash tray 4. As shown in FIG. 2, a refuse guide plate 10 is provided on an inner surface at the lower edge of the refuse inlet opening, the plate inclining downwardly toward the center of enclosure 1.

A refuse collecting bag which is mounted within outer enclosure 1 may comprise a continuous, elongated, vinyl sleeve 7 folded several times on itself in fanfold manner to an appropriate length outwardly and inwardly by turns starting from one end thereof. The sleeve therefore has a fanfolded upper end of several folded layers.

Folded vinyl sleeve 7 is mounted on the outer peripheral surface of a tubular holder 6 having substantially the same length and outer diameter as the folded length and inner diameter of the sleeve, one end of the folded sleeve being pulled downwardly through holder 6 and being tied into a knot as at *7a, 7b.*

Outwardly facing flanges *6a* are provided along the periphery at the lower end of holder 6 and a pair of opposing elongated support members are mounted on inner surfaces of the upper portion of enclosure 1 for supporting holder 6 via a pair of opposed flanges *6a,* so as to facilitate insertion and removal of holder 6 as a pair of opposed flanges *6a* are slid along supports 5.

The refuse receptacle is shown assembled for use in FIG. 2 with holder 6 having folded sleeve 7 supported thereon being mounted on the inside of the upper portion of enclosure 1 via flanges *6a* and support members 5.

In use, door 3 in the front upper portion of the refuse receptacle 1 is opened and refuse is inserted, being deposited downwardly along guide plate 10 into the refuse collecting bag comprising vinyl sleeve 7 which is knotted at its lower end as at *7a, 7b.*

When the portion of the refuse collecting bag extending downwardly within enclosure 1 is filled with refuse as shown in FIG. 2, front door 2 is opened and the empty portion upwardly of the refuse filled portion of the sleeve is grasped and cut on a semicircular knife 11 provided on the inside of door 2, after the refuse filled portion is removed from the enclosure, as shown in phantom outline in FIG. 2.

Then, each of the two end portions may be cutting the sleeve described above is tied as at *7a, 7b* such that the refuse filled bag is sealed for carrying away and the remaining vinyl sleeve supported on the holder 6 is ready for again collecting refuse.

Obviously, many modifications and variations of the invention are made possible in the light of the above teachings. It is therefore to be understood that within the scope of the appended claims the invention may be practiced otherwise then as specifically described.

I claim:

1. A refuse receptacle comprising, an outer upstanding enclosure and a refuse collecting bag mounted therein, said outer enclosure having a refuse inlet opening in a front upper portion thereof and an opening for removing the bag when filled with refuse, a tubular bag holder mounted on the inside of the upper portion of said outer enclosure, said holder having outwardly extending flanges at a lower end thereof, said bag comprising a continuous elongated vinyl sleeve having a fanfolded upper end of several upstanding folded layers, said upper end of said sleeve being mounted on the outer peripheral surface of said holder which has substantially the same length and outer dimension as the folded length and inner diameter of said fanfolded upper end of said sleeve, and said fanfolded upper end of said sleeve being solely supported by said flanges, said sleeve extending from said fanfolded upper end thereof over an upper end of said holder and through the inside of said holder so as to terminate at its free end beyond said lower end thereof, said free end of said sleeve being tied for closing same.

2. A refuse receptacle according to claim 1, further comprising a pair of opposed elongated support members mounted on the inside of an upper portion of said enclosure for supporting said holder as said flanges overlie said support members.

3. A refuse receptacle according to claim 1, wherein said front upper portion of said enclosure inclines rearwardly from a front portion of said enclosure, a refuse guide plate mounted on the inside of a lower end of said refuse inlet opening, said plate inclining downwardly toward the center of said outer enclosure for giding refuse thereto.

4. A refuse receptacle according to claim 1, wherein an upper end of said outer enclosure is adapted for mounting an ash tray.

5. A refuse receptacle according to claim 1, wherein a first hinged door covers said refuse inlet opening and a second hinged door covers said opening for removing the filled bag, said second door having a cutter blade mounted on the inside thereof for use in separating said refuse filled bag from the folded sleeve.

* * * * *